US009598229B2

(12) United States Patent
Rutstrom et al.

(10) Patent No.: US 9,598,229 B2
(45) **Date of Patent: *Mar. 21, 2017**

(54) CONTAINER AND METHOD FOR STORAGE AND TRANSPORT OF SUPPORTED CONTENTS

(71) Applicant: Alliance Packaging, LLC, Renton, WA (US)

(72) Inventors: Lawrence L. Rutstrom, Kent, WA (US); George Jamison, Gig Harbor, WA (US)

(73) Assignee: Alliance Packaging, LLC, Renton, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/962,985

(22) Filed: Dec. 8, 2015

(65) Prior Publication Data

US 2016/0090231 A1 Mar. 31, 2016

Related U.S. Application Data

(63) Continuation of application No. 13/761,018, filed on Feb. 6, 2013, now Pat. No. 9,211,997.

(51) Int. Cl.

| | |
|---|---|
| ***B65D 85/50*** | (2006.01) |
| ***B65D 5/50*** | (2006.01) |
| ***B65D 5/54*** | (2006.01) |
| ***B65B 21/02*** | (2006.01) |
| ***B65B 25/02*** | (2006.01) |

(Continued)

(52) U.S. Cl.

CPC ..... *B65D 85/505* (2013.01); *B65B 21/025* (2013.01); *B65B 25/023* (2013.01); *B65B 43/10* (2013.01); *B65B 61/20* (2013.01); *B65D 5/4204* (2013.01); *B65D 5/48024* (2013.01); *B65D 5/5028* (2013.01); *B65D 5/541* (2013.01); *B65B 51/067* (2013.01)

(58) Field of Classification Search

CPC ..... B65D 85/42; B65D 85/505; B65D 85/52; B65D 5/4204; B65D 5/46088; B65D 5/5028; B65D 5/5035; B65D 5/5038; B65D 5/541; B65D 25/04; B65D 75/24; B65D 77/0413; A01G 9/02; A01G 9/026; B60R 7/085; Y10S 229/902; Y10S 229/906; Y10S 229/939; Y10S 229/94

USPC ..... 206/277, 423, 591–592, 756–757, 784; 229/120.18, 120.36, 120.38, 122.32, 229/122.34; 47/62, 84; 220/500, 529, 220/541–542, 552, 557; 53/133.1–133.2, 53/139.5, 565; 493/52, 84, 87

See application file for complete search history.

(56) References Cited

U.S. PATENT DOCUMENTS

| | | | |
|---|---|---|---|
| 760,866 | A | 5/1904 | Hohoff |
| 880,549 | A | 3/1908 | Lord |

(Continued)

*Primary Examiner* — J. Gregory Pickett
*Assistant Examiner* — Brijesh V. Patel
(74) *Attorney, Agent, or Firm* — Seed IP Law Group LLP

(57) ABSTRACT

A container for transporting an item is provided having an outer case member and a pair of partition members. The container is erectable from a collapsed configuration, in which the container is substantially flat, to an erected configuration in which the partition members form a support structure within an interior cavity of the outer case member to support a portion of the item to be transported. Methods of packaging and transporting an item in a container are also provided.

19 Claims, 4 Drawing Sheets

(51) Int. Cl.

| | |
|---|---|
| ***B65B 43/10*** | (2006.01) |
| ***B65B 61/20*** | (2006.01) |
| ***B65D 5/42*** | (2006.01) |
| ***B65D 5/49*** | (2006.01) |
| *B65B 51/06* | (2006.01) |

(56) References Cited

U.S. PATENT DOCUMENTS

| | | | | |
|---|---|---|---|---|
| 1,337,091 | A | 4/1920 | Neski | |
| 1,493,152 | A | 5/1924 | Gardner | |
| 1,606,523 | A | 11/1926 | Gardner | |
| 1,669,617 | A | 5/1928 | Kennedy | |
| 2,682,949 | A | 7/1954 | Whitehead | |
| 3,095,086 | A | 6/1963 | Berg | |
| 3,229,889 | A | 1/1966 | Vrana | |
| 3,352,053 | A | 11/1967 | Anderson | |
| 3,752,035 | A | 8/1973 | Cozzy et al. | |
| 3,829,003 | A | 8/1974 | Dilot | |
| 3,973,356 | A | 8/1976 | Schacht | |
| 4,105,154 | A | 8/1978 | Meyers et al. | |
| 4,209,092 | A | 6/1980 | Jones | |
| 4,213,559 | A | 7/1980 | Meyers | |
| 4,335,842 | A * | 6/1982 | Bradford | B65D 5/4804 229/120.24 |
| 4,470,539 | A * | 9/1984 | Skillen | B65D 5/48028 206/427 |
| 4,957,237 | A | 9/1990 | Madonna et al. | |
| 5,044,548 | A * | 9/1991 | Olsen | B65D 5/48014 229/120.03 |
| 5,402,889 | A | 4/1995 | Hermann et al. | |
| 5,803,267 | A | 9/1998 | Tu et al. | |
| 5,938,109 | A | 8/1999 | Sainz et al. | |
| 6,059,180 | A | 5/2000 | Collins | |
| 6,463,697 | B2 * | 10/2002 | Weder | B65D 85/505 211/74 |
| 6,789,678 | B2 | 9/2004 | Auclair | |
| 7,007,426 | B1 * | 3/2006 | Ohlman, III | B65D 85/52 47/84 |
| 7,219,797 | B2 | 5/2007 | Kroeze et al. | |
| D581,783 | S | 12/2008 | Dixon | |
| 7,533,771 | B2 | 5/2009 | Allison | |
| 7,584,855 | B2 | 9/2009 | Rutstrom | |
| 7,980,454 | B2 | 7/2011 | Burton et al. | |
| 2002/0179474 | A1 * | 12/2002 | Levieux | A47G 7/025 206/423 |
| 2005/0045496 | A1 | 3/2005 | Jenkins | |
| 2010/0147935 | A1 * | 6/2010 | Younger | B65D 5/48036 229/120.18 |
| 2013/0264363 | A1 | 10/2013 | Ballou et al. | |
| 2014/0217102 | A1 | 8/2014 | Wilson et al. | |
| 2014/0263353 | A1 | 9/2014 | Bell | |

* cited by examiner

CONTAINER AND METHOD FOR STORAGE AND TRANSPORT OF SUPPORTED CONTENTS

BACKGROUND

Technical Field

This disclosure is generally related to containers, and more particularly, to containers and related methods for packaging fragile contents, such as, for example, flowers, for transport.

Description of the Related Art

In commercial and private settings, users have long benefited from containers, such as corrugated paperboard containers, when shipping goods, gifts, and other items. Furthermore, due to the increasingly interstate and global nature of relationships and businesses, individuals and businesses often communicate through remote gestures and distant dealings, such as shipping goods and/or gifts. Frequently, these items are fragile, as is the case when shipping flowers and breakables. Consequently, senders expend time, money and additional material to support and secure contents of the container for transport. Accordingly, existing containers include those designed to reduce assembly time and material while better securing the contents.

Some solutions include corrugated containers having a divider that provides some support of the contents. However, even when using these corrugated containers, the contents continue to experience some movement during transport. Consequently, other solutions include ties inserted through tie holes and engaging a portion of the contents as well as being tied to a portion of one of the box sides, further securing the contents in place. This tying process is time-consuming, cumbersome, and costly for individuals and businesses that ship many items, especially fragile items, such as flowers, on a regular basis. For such businesses, saving even a few seconds when assembling each container amounts to a sizeable time and cost savings over a longer duration such as a day, a week or a month.

Additionally, ties such as strings, ribbons, or wires used to secure contents such as flowers also make opening conventional containers difficult. Particularly, when the contents are fragile, recipients of conventional containers often spend excess time and effort to untie the contents from the container to prevent damaging the contents. Furthermore, tying fragile and delicate contents such as flowers introduces additional opportunity for damaging the contents during transport.

Examples of corrugated containers for shipping fragile items such as flowers using wires or ties are disclosed in U.S. Pat. No. 7,219,797, which is incorporated herein by reference in its entirety. Examples of corrugated containers for shipping fragile items such as flowers in a tieless manner are disclosed in U.S. Pat. No. 7,584,855, which is incorporated herein by reference in its entirety.

BRIEF SUMMARY

Embodiments described herein provide container structures that are erectable in a particularly efficient manner and well adapted to transport fragile or delicate items, such as flowers. Embodiments may also be configured to support and transport items with reduced material demands relative to conventional containers for transporting similar items.

According to one embodiment, a container for transporting items, such as, for example, flowers, may be summarized as including an outer case member having a plurality of sidewall panels and a plurality of base panels, the outer case member erectable from a collapsed configuration, in which the container is substantially flat, to an erected configuration, in which the plurality of sidewall panels and the plurality of base panels collectively define an interior cavity to receive the item to be transported; and a pair of partition members, each partition member having a foot panel, a side panel and a support panel, the foot panel of each partition member fixedly coupled to a respective one of the plurality of base panels of the outer case member, the side panel of each partition member fixedly coupled to a respective one of the plurality of sidewall panels of the outer case member, and the support panel of each partition member provided between the foot panel and the side panel of each respective partition member to collectively partition the interior cavity of the outer case member into opposing regions and to support a portion of the item to be transported when the outer case member is erected.

Each partition member may further include a supplemental support panel foldably coupled to the support panel, the supplemental support panels of the partition members collectively defining a V-shaped trough on which to support the portion of the item to be transported when the outer case member is in the erected configuration. Each of the supplemental support panels may include a lock device to secure the partition members in a support configuration when the outer case member is in the erected configuration. For each partition member, the support panel may be generally normal to the side panel when the outer case member is in the erected configuration and may be generally parallel to the side panel when the outer case member is in the collapsed configuration. For each partition member, the support panel may be connected to the foot panel by a respective intermediary web panel such that, when the outer case member moves from the collapsed configuration to the erected configuration, the foot panel rotates the support panel relative to the side panel via the intermediary web panel. When the outer case member is in the erected configuration, each intermediary web panel may be inclined relative to the base panels of the outer case member toward a central region of the interior cavity.

At least one of the partition members may include a wedge device that cooperates with the support panels of the partition members to define a window when the outer case member is in the erected configuration. The wedge device may be selectively adjustable to change a size of the window. The wedge device may be coupled to the side panel of the partition member by an upper panel.

According to another embodiment, an erectable container to transport flowers may be summarized as including an outer case member and a pair of partition members attached to the outer case member, the partition members configured to at least partially erect into a stem support structure as the outer case member is erected from a collapsed configuration to an erected configuration, the stem support structure providing a support trough offset from a floor of the outer case member when the stem support structure is completely erected and locked in a support configuration. The stem support structure may partition the interior cavity of the outer case member into opposing regions when the outer case member is in the erected configuration and the stem support structure is locked in the support configuration.

The outer case member may include a plurality of sidewall panels and a plurality of base panels, and each partition member may include a foot panel, a side panel and a support panel, the foot panel of each partition member fixedly coupled to a respective one of the plurality of base panels of the outer case member, the side panel of each partition member fixedly coupled to a respective one of the plurality of sidewall panels of the outer case member, and the support panel of each partition member provided between the foot panel and the side panel of each respective partition member. Each partition member may further include a supplemental support panel foldably coupled to the support panel, the supplemental support panels of the partition members collectively defining the support trough on which to support stems of the flowers to be transported when the outer case member is in the erected configuration and the stem support structure is locked in the support configuration. Each of the supplemental support panels may include a lock device to secure the stem support structure in the support configuration with the outer case member in the erected configuration. For each partition member, the support panel may be generally normal to the side panel when the outer case member is in the erected configuration and may be generally parallel to the side panel when the outer case member is in the collapsed configuration. For each partition member, the support panel may be connected to the foot panel by a respective intermediary web panel such that, when the outer case member moves from the collapsed configuration to the erected configuration, the foot panel rotates the support panel relative to the side panel via the intermediary web panel. At least one of the partition members may include a wedge device that cooperates with the stem support structure when the outer case member is in the erected configuration to define a window.

According to another embodiment, a method of packaging an item in a container for transport may be summarized as including: erecting an outer case member from a collapsed configuration to an erected configuration to define an interior cavity to receive the item, whereby erecting the outer case member simultaneously moves a pair of opposing partition members coupled to the outer case member toward a support configuration; locking the partition members in the support configuration; and placing an item in the interior cavity of the outer case member with a portion of the item supported by the partition members in the support configuration. The method may further include, after placing the item in the interior cavity, positioning a wedge member relative to the partition members to establish a window through which the item extends and/or wedging the item between a wedge member and the partition members in the support configuration. The method may further include sealing the outer case member in a closed configuration, whereby sealing the outer case member in the closed configuration maintains the wedge member in position relative to the partition members to secure the item therebetween. Placing the item in the interior cavity of the outer case member may include positioning at least one flower within a vase disposed in the interior cavity of the outer case member with a stem of the flower in contact with the partition members. Locking the partition members in the support configuration may include locking the partition members in a trough arrangement to support a portion of the item offset from a floor of the outer case member.

DETAILED DESCRIPTION

In the following description, certain specific details are set forth in order to provide a thorough understanding of various disclosed embodiments. However, one of ordinary skill in the relevant art will recognize that embodiments may be practiced without one or more of these specific details. In other instances, well-known structures associated with corrugated paperboard containers and methods of forming and erecting corrugated paperboard containers may not be shown or described in detail to avoid unnecessarily obscuring descriptions of the embodiments. For instance, it will be appreciated by those of ordinary skill in the relevant art that conventional folder-gluer machines or other conventional forming machines may be used to form the container structures described herein. In addition, it will be appreciated that the container structures described herein can be fabricated from materials that are formable and which can maintain a shape after being formed, such as, for example, corrugated paperboard. Still further, it will be appreciated that various panels of the container structures described herein may be separated by features configured to promote folding of the panels relative to each other. These features may include, for example, perforations, creases, score lines, cut lines, fold lines or any other features to promote folding between the panels.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases in "one embodiment" or in "an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

Embodiments described herein provide container structures that are erectable in a particularly efficient manner and well adapted to receive and transport fragile or delicate items, such as flowers. Embodiments may also be configured to support and transport items with reduced material demands relative to conventional containers for transporting similar items.

Figure 1:
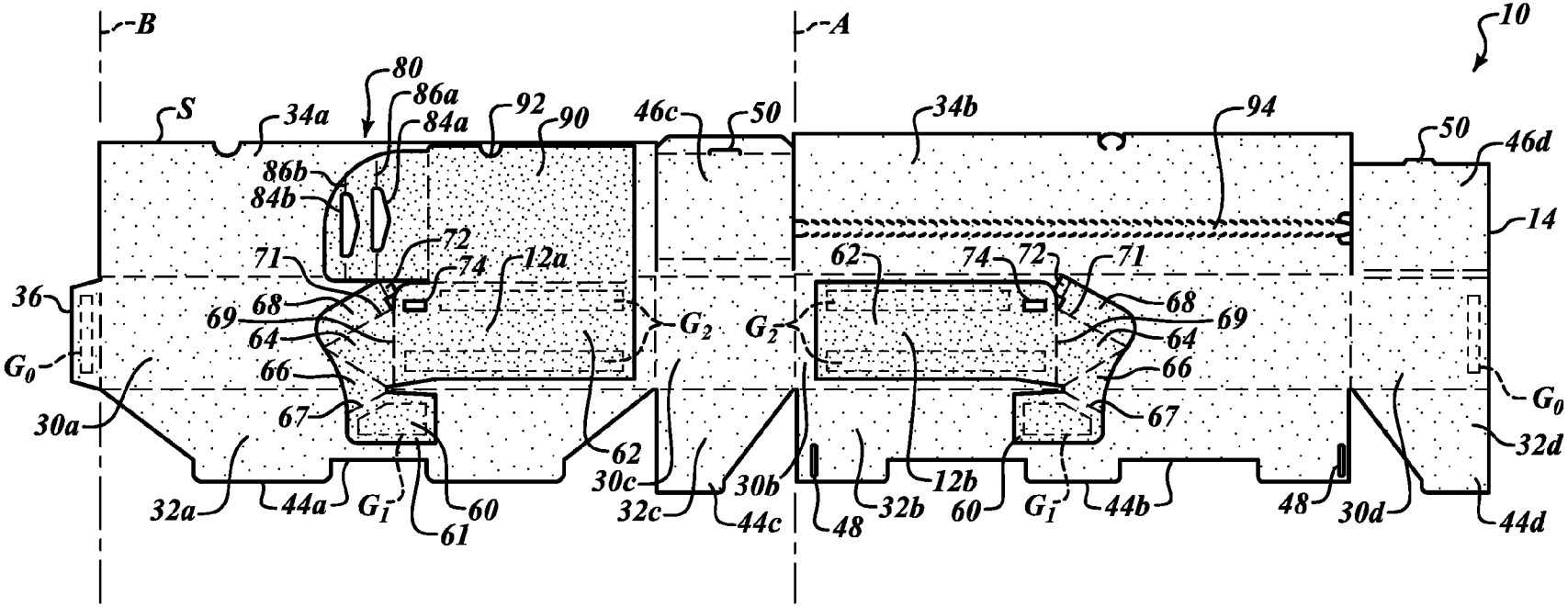
FIG. 1 is a plan view of a container structure in a splayed configuration showing a pair of partition members coupled to interior surfaces of an outer case member.
Figure 2:
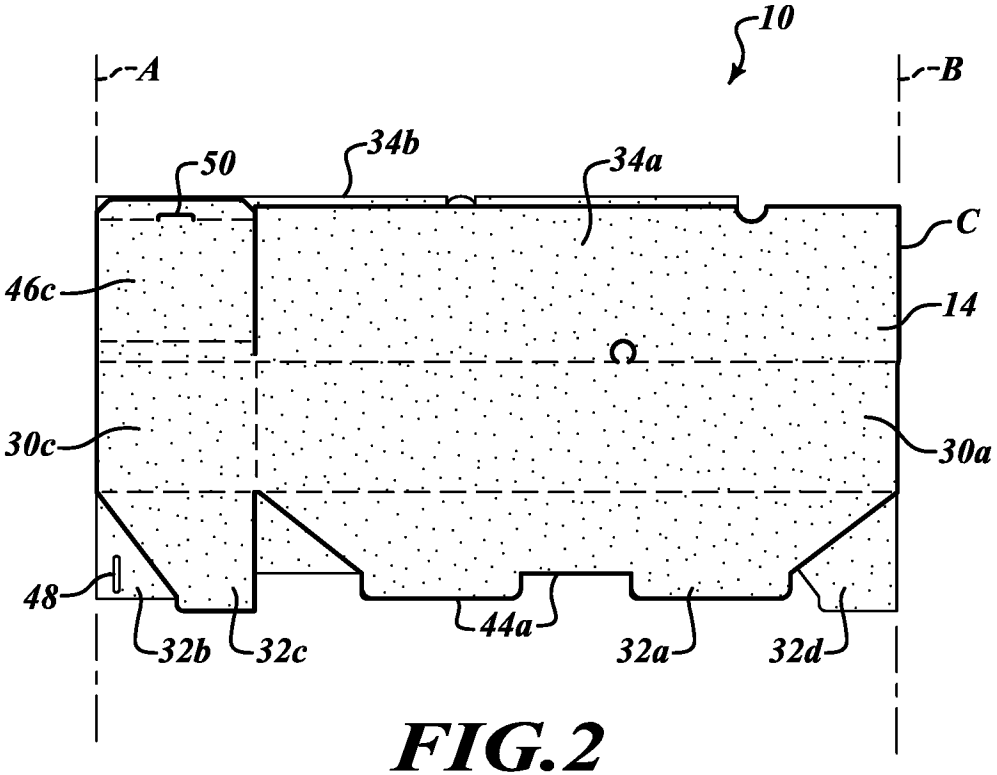
FIG. 2 is a plan view of the container structure of FIG. 1 in a sleeve configuration, which is erectable to form a container with an interior cavity for receiving and transporting items, such as, for example, flowers.
Figure 3:
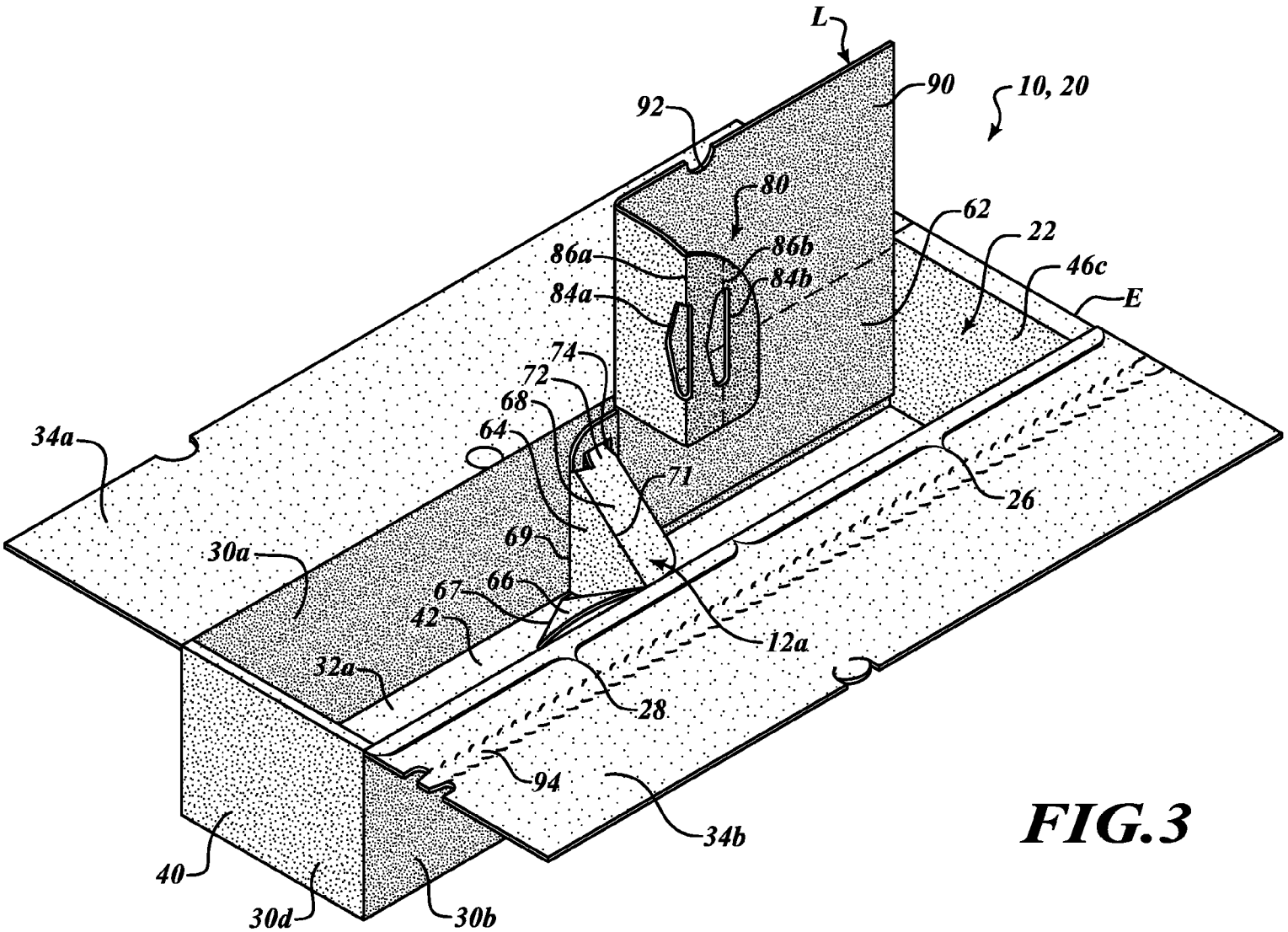
FIG. 3 is an isometric view of the container structure of FIG. 1 in an erected configuration with an end portion of the container in a loading configuration.
Figure 4:
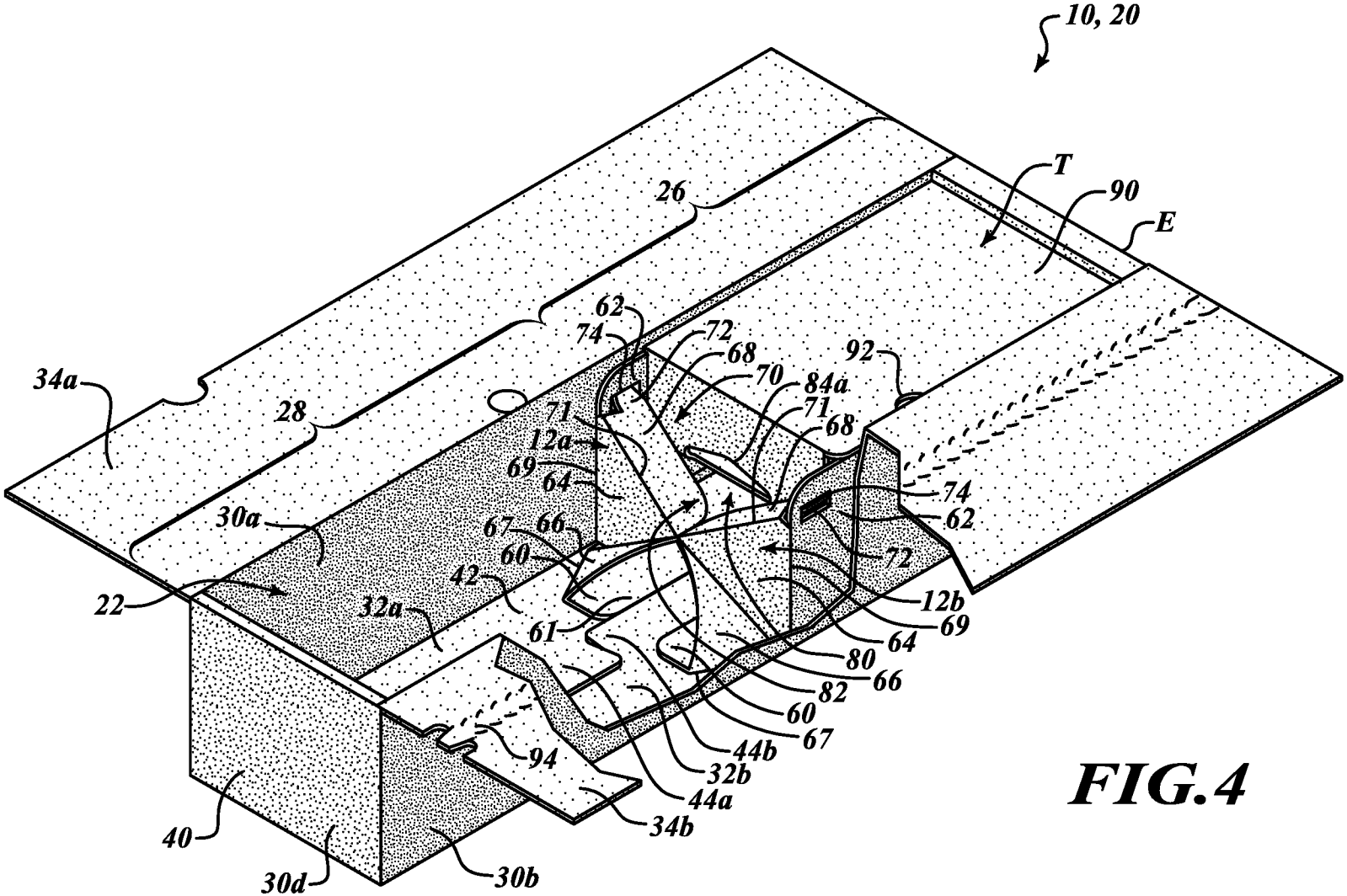
FIG. 4 is an isometric view of the container structure of FIG. 1 in the erected configuration with the end portion of the container in a transport configuration and with a portion of the container broken away to reveal additional details thereof.

FIGS. 1 through 4 show an example embodiment of a container structure 10 for transporting items, such as, for example, flowers, in a particularly secure and well-supported manner. FIG. 1 shows the container structure 10 in a splayed configuration S with a pair of partition members 12*a*, 12*b* attached to interior surfaces of an outer case member 14. FIG. 2 shows the container structure 10 in a sleeve or collapsed configuration C, which is erectable to form a container 20 (FIGS. 3 and 4) having an interior cavity 22 for receiving and transporting flowers or other items. Finally, FIG. 3 shows the container structure 10 in an erected configuration E with an end portion 26 of the container 20 in a loading configuration L, while FIG. 4 shows the container structure 10 in the erected configuration E with the end portion 26 of the container 20 in a transport configuration T.

With reference to FIG. 1, the outer case member 14 of the container structure 10 includes a plurality of sidewall panels 30*a-d*, a plurality of base panels 32*a-d*, a plurality of closure panels 34*a*, 34*b* and an end flange 36, which are foldably connected to each other to erect to form a generally rectangular outer case 40, as shown in FIGS. 3 and 4, within which to receive and transport items. More particularly, the outer case member 14 is erectable from the sleeve or collapsed configuration C shown in FIG. 2, in which the container structure 10 is substantially flat, to the erected configuration E shown in FIGS. 3 and 4 in which the plurality of sidewall panels 30*a-d* and the plurality of base panels 32*a-d*collectively define the interior cavity 22 for receiving and transporting flowers or other items.

The base panels 32*a-d* of the outer case member 14 may overlap in a conventional manner when folded to collectively form a floor or base 42 of the erected container 20, as shown best in FIG. 4. With reference back to FIG. 1, the base panels 32*a-d* may include interlocking features 44*a-d*, which collectively lock the base 42 and container 20 in the erected configuration E shown in FIGS. 3 and 4, without the use of adhesives or other fastening devices. In order to lock the base 42 and container 20 in the erected configuration E, the base panels 32*a-d* may be folded in an overlapping manner and moved past a horizontal position until the interlocking features 44*a*, 44*b* of the base panels 32*a*, 32*b* initially interlock. After the interlocking features 44*a*, 44*b* of the base panels 32*a*, 32*b* initially interlock, the base panels 32*a-d* may relax back toward a horizontal position until the interlocking features 44*a*, 44*b* of the base panels 32*a*, 32*b* bottom out and hold the base panels 32*a-d* in a generally horizontal configuration. The interlocking nature of the interlocking features 44*a*, 44*b* of the base panels 32*a*, 32*b* is best shown in the cutaway portion of FIG. 4. Advantageously, in some embodiments, an end portion 61 of a foot panel 60 of one of the partition members 12*a* may be positioned with respect to the interlocking features 44*a*, 44*b* of the base panels 32*a*, 32*b* to abut a portion of the interlocking features 44*a*, 44*b* when the interlocking features 44*a*, 44*b* are interlocked to assist in holding the base panels 32*a*, 32*b* together in the erected configuration E.

With reference again to FIG. 1, the outer case member 14 of the container structure 10 may further include a plurality of end panels 46*c*, 46*d* foldably coupled to respective sidewall panels 30*c*, 30*d*, which are configured to fold inwardly toward the base panels 32*a*, 32*b* after erection of the outer case member 14. Upon folding, the end panels 46*c*, 46*d* may engage locking apertures 48 provided in a portion of the base panel 32*b* which are exposed to the interior cavity 22 of the erected container 20. For this purpose, each of the end panels 46*c*, 46*d* may be provided with a locking tab 50 of other feature for engaging the locking apertures 48. When locked in this manner, the end panels 46*c*, 46*d* and the respective sidewall panels 30*c*, 30*d* to which they are foldably coupled may form a dual-walled structure at opposing ends of the erected container 20. The panels 30*c*, 30*d*, 46*c*, 46*d* of this dual-walled structure may be flush or offset from each other. When locked in the manner described above, the container structure 10 is held securely in the erected configuration E shown in FIGS. 3 and 4.

With reference again to FIG. 1, the pair of partition members 12*a*, 12*b* are coupled to interior surfaces of an outer case member 14. Each partition member 12*a*, 12*b* includes a foot panel 60, a side panel 62 and a support panel 64. The foot panel 60 of each partition member 12*a*, 12*b* is fixedly coupled to a respective one of the plurality of base panels 32*a*, 32*b* of the outer case member 14, such as, for example, by adhesive $G_1$ or other fastening devices. Similarly, the side panel 62 of each partition member 12*a*, 12*b* is fixedly coupled to a respective one of the plurality of sidewall panels 30*a*, 30*b* of the outer case member 14, such as, for example, by adhesive $G_2$ or other fastening devices. Accordingly, in the splayed configuration S shown in FIG. 1, as well as the sleeve or collapsed configuration C shown in FIG. 2, the partition members 12*a*, 12*b* may lay flat against the outer case member 14 and span across a respective interface between the sidewall panels 30*a*, 30*b* and the base panels 32*a*, 32*b* of the outer case member 14.

The support panel 64 of each partition member 12*a*, 12*b* is provided between the foot panel 60 and the side panel 62 of each respective partition member 12*a*, 12*b*. In addition, an intermediary web panel 66 is provided between the foot panel 60 and the support panel 64 such that, when the outer case member 14 moves from the collapsed configuration C (FIG. 2) to the erected configuration E (FIGS. 3 and 4), the foot panel 60 rotates the support panel 64 via the intermediary web panel 66 from an initial configuration in which the support panel 64 is generally parallel to the side panel 62 to a support configuration in which the support panel 64 is generally perpendicular to the side panel 62. More particularly, as each foot panel 60 moves with the base panels 32*a*, 32*b* of the outer case member 14 into the erected configuration E, the intermediary web panels 66 are moved via their connection to the foot panels 60 at respective fold lines 67 and draw the support panels 64 away from the sidewall panels 30*a*, 30*b* of the outer case member 14 as the support panels 64 bend about respective folds lines 69 that are provided between the support panels 64 and the side panels 62. In this manner, the support panels 64 may be moved into a support configuration by simply folding and interlocking the base panels 32*a*, 32*b* of the outer case member 14 into the erected configuration E.

With continued reference to FIG. 1, each partition member 12*a*, 12*b* may further include a supplemental support panel 68 that is foldably coupled to the support panel 64 of each respective partition member 12*a*, 12*b* about a respective fold line 71. After the outer case member 14 moves from the collapsed configuration C (FIG. 2) to the erected configuration E (FIGS. 3 and 4) and the foot panel 60 rotates the support panel 64 relative to the side panel 62 via the intermediary web panel 66 as described above, the supplemental support panel 68 of each partition member 12*a*, 12*b* may be folded relative to each respective support panel 64 about fold line 71 to collectively define a V-shaped trough 70. The trough 70 is suitable to support a portion of the item to be transported, such as, for example, the stem of a flower.

Each of the supplemental support panels 68 may include a lock device 72 to secure the partition members 12*a*, 12*b* in a support configuration when the outer case member 14 is in the erected configuration. The lock device 72 may be a locking tab, for example, and may engage a corresponding locking aperture 74 provided in the side panel 62 of the partition member 12*a*, 12*b*. The locking tab may be foldably coupled to the supplemental support panel 68 and may bend slightly relative to the supplemental support panel 68 when moved into locking engagement with the locking aperture 74. In this locked configuration, the partition members 12*a*, 12*b* are securely held in the support configuration shown in FIGS. 3 and 4.

After the container structure 10 is formed into the sleeve or collapsed configuration C shown in FIG. 2 and subsequently erected into the erected configuration E, the partition members 12*a*, 12*b* may collectively partition the interior cavity 22 of the outer case member 14 into opposing regions or end portions 26, 28. For example, the partition members 12*a*, 12*b* may partition the interior cavity 22 into a first end portion 26 and a second end portion 28. The first end portion 26 may be configured to receive a receptacle or vessel, such as a vase, within which the item or items to be transported may be provided. The item or items to be transported may extend from the receptacle or vessel when disposed in the first end portion 26 into the second end portion 28 with an intermediate portion of the item or items supported by the support structure provided by the partition members 12*a*, 12*b*.

The support panel 64 of each partition member 12*a*, 12*b* may be generally parallel to the sidewall panel 30*a*, 30*b* to which the partition member 12*a*, 12*b* is attached when the outer case member 14 is in the collapsed configuration C shown in FIG. 2. Conversely, when the container structure 10 is erected into the erected configuration E shown in FIGS. 3 and 4, the support panel 64 of each partition member 12*a*, 12*b* may be drawn into a position that is generally normal to the sidewall panel 30*a*, 30*b* to which the partition member 12*a*, 12*b* is attached. Furthermore, when the outer case member 14 is in the erected configuration E, each intermediary web panel 66 may be moved into a position wherein the intermediary web panel 66 is inclined relative to the base panels 32*a*, 32*b* of the outer case member 14 toward a central region of the interior cavity 22, as shown best in FIG. 4. In the final, locked support configuration, the supplemental support panels 68 may extend generally normal to the support panels 64 to provide the V-shaped trough 70. Advantageously, the V-shaped trough 70 is configured to support a portion of an item or items to be transported offset from the base 42 of the erected container 20. In some embodiments, for example, the trough 70 may be configured to support a portion of an item about midway between the base 42 of the erected container 20 and the closure panels 34*a*, 34*b*.

With reference to FIGS. 1, 3 and 4, at least one of the partition members 12*a*, 12*b*, may be provided with a wedge device 80 for selectively wedging the item or items to be transported into the V-shaped trough 70 defined by the partition members 12*a*, 12*b* when the container structure 10 is in the erected configuration E. For example, the wedge device 80 may be configured to cooperate with the support panels 64 and supplemental support panels 68 of the partition members 12*a*, 12*b* to define a window 82 when the container structure 10 is in the erected configuration E. When viewing the window 82 in a direction normal to the end sidewall panels of the 30*c*, 30*d*, the window 82 may have a diamond shaped, triangular shaped or other shaped profile that may be well suited to receive and pack a plurality of like items (e.g., flower stems) in a secure manner. The shape of the window 82 may be defined by a projected profile of the V-shaped trough 70 and a portion of an aperture 84*a*, 84*b* of the wedge device 80.

The wedge device 80 may be adjustable to adjust a size of the window 82. For example, the wedge device 80 may include pre-formed creases, scores, perforations or other features 86*a*, 86*b* that facilitate folding the wedge device 80 into one of several possible wedge configurations. For example, the example embodiment of the container structure 10 of FIGS. 1 through 4 show the wedge device 80 with two pre-formed features 86*a*, 86*b* for selectively folding the wedge device 80 into two different wedge configurations. FIGS. 3 and 4 show the wedge device 80 bent about one of the pre-formed features 86*a* for selectively folding the wedge device 80 into one configuration that is adapted to define a window 82 that is relatively larger than if the wedge device 80 was folded about the other pre-formed feature 86*b*.

The wedge device 80 may be coupled to the side panel 62 of the partition member 12*a* by an upper panel 90. The upper panel 90 may be configured to enable selective movement of the wedge device 80 into and out of engagement with the item or items to be transported by rotating the upper panel 90 relative to the side panel 62. The upper panel 90 may be sized and shaped to substantially cover the first end portion 26 of the interior cavity 22 of the erected container 20 after moving the wedge device 80 into engagement with the item or items to be transported. In this manner, the upper panel 90, the support structure of the partition members 12*a*, 12*b* and the outer case member 14 may form a sub-compartment that substantially encloses the first end portion 26 of the interior cavity 22 irrespective of the position of the closure panels 34*a*, 34*b* of the outer case member 14. Accordingly, a receptacle or vessel, such as a vase, may be enclosed within the first portion 26 of the interior cavity 22 of the erected container 20 prior to folding the closure panels 34*a*, 34*b*. A cutout 92, tab or other feature may be provided to facilitate moving the upper panel 90 and hence wedge device 80 away from the transport configuration T (FIG. 4) to reveal the receptacle or vessel and item or items stored therein.

In view of the above, it will be appreciated by those of ordinary skill in the relevant art that a method of packaging an item in a container 20 for transport may be provided which includes erecting an outer case member 14 from a collapsed configuration C to an erected configuration E to define an interior cavity 22 to receive the item, whereby erecting the outer case member 14 simultaneously moves a pair of opposing partition members 12*a*, 12*b* coupled to the outer case member 14 toward a support configuration; locking the partition members 12*a*, 12*b* in the support configuration; and placing an item in the interior cavity 22 of the outer case member 14 with a portion of the item supported by the partition members 12*a*, 12*b* in the support configuration. Placing the item in the interior cavity 22 of the outer case member 14 may include positioning a vase of flowers in the interior cavity 22 of the outer case member 14 with at least one stem of the flowers in contact with the partition members 12*a*, 12*b*. The partition members 12*a*, 12*b* may be locked in a trough arrangement to support a portion of the item offset from a floor or base 42 of the outer case member 14.

The method may further include, after placing the item in the interior cavity 22, positioning a wedge member 80 relative to the partition members 12*a*, 12*b* to establish a window 82 through which the item extends and wedging the item between the wedge member 80 and the partition members 12*a*, 12*b* in the support configuration. The method may conclude with sealing the outer case member 14 in a closed configuration, such as, for example, by positioning closure panels 34*a*, 34*b* over the interior cavity 22 and securing the closure panels 34*a*, 34*b* in the closed configuration with adhesive, tape or other devices. Advantageously, sealing the outer case member 14 in the closed configuration may maintain the wedge member 80 in position relative to the partition members 12*a*, 12*b* to secure the item therebetween while the item is transported.

With reference to FIGS. 1 and 2, the collapsed configuration C of the outer case member 14 may be formed by cutting a blank of corrugated paperboard material to include a plurality of sidewall panels 30*a-d*, a plurality of base panels 32*a-d*, and a plurality of closure panels 34*a*, 34*b*, which are foldably connected to each other to erect to form a generally rectangular outer case 40; attaching the partition members 12*a*, 12*b* to the blank of the outer case member 14 while in a substantially flat configuration; and then folding the outer case member about fold lines A, B; and securing end flange 36 to sidewall panel 30*d* with adhesive $G_0$ or other fastening devices, such as, for example, staples or tape.

To attach the partition members 12*a*, 12*b* to the blank of the outer case member 14, the foot panel 60 of each partition member 12*a*, 12*b* may be fixedly coupled to a respective one of the plurality of base panels 32*a*, 32*b* of the outer case member 14, such as, for example, by adhesive $G_1$ or other fastening devices. Similarly, the side panel 62 of each partition member 12*a*, 12*b* may be fixedly coupled to a respective one of the plurality of sidewall panels 30*a*, 30*b* of the outer case member 14, such as, for example, with adhesive $G_2$ or other fastening devices. In this position, the upper panel 90 of one of the partition members 12*a* may overlie a portion of the closure panel 34*a* that is foldably coupled to the sidewall panel 30*a* to which the partition member 12*a* is attached. The partition members 12*a*, 12*b* may be attached to the outer case member 14 with the partition members 12*a*, 12*b* entirely within the outer profile of the folded outer case member 14.

The partition members 12*a*, 12*b* may each be formed from a blank of corrugated paperboard material having the same thickness or a different thickness from that of the blank of the outer case member 14. The maximum thickness of the container structure 10 in the splayed configuration S shown in FIG. 1 may therefore be equal to the thickness of the blank of the outer case member 14 and the blank of a partition member 12*a*, 12*b*, whereas the maximum thickness of the container structure 10 in the sleeve or collapsed configuration C shown in FIG. 2 may be equal to twice the thickness of the outer case member 14 and the collective thickness of the blanks of the partition members 12*a*, 12*b*. Due to the generally flat and relatively thin nature of the container structures 10 in the sleeve or collapsed configuration C shown in FIG. 2, a plurality of the container structures 10 can be conveniently stacked in the sleeve or collapsed configuration C for storage or shipment in bulk to remote locations, such as, for example, floral shops for subsequent erection and use in packaging and shipping delicate items, such as flowers, to customers.

As one of ordinary skill in the relevant art will appreciate, a recipient of a container 20 according to embodiments described herein will benefit from features of the same. For example, the recipient may quickly gain access to the items within the container 20 by removing a tear strip 94, opening the closure panels 34*a*, 34*b* and lifting the upper panel 90 via the cutout 92 without requiring tools, such as scissors or a knife. Still further, the container 20 can be quickly broken down to the sleeve or collapsed configuration C shown in FIG. 2 for recycling purposes.

Although the example embodiment of the container structures 10 shown in FIGS. 1 through 4 erect to form a generally elongated, rectangular container 20 that is partitioned about midway along a length thereof, it is appreciated that in other embodiments, an erected container may be provided having a different shape and may include a partition or partitions at other positions along a length thereof. Additionally, although the partition members 12*a*, 12*b* of the illustrated embodiment of FIGS. 1 through 4 erect to form a butterfly-shaped support structure, it is appreciated that in other instances the partition members 12*a*, 12*b* may erect to create a support structure having other forms.

Moreover, the various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A container for transporting an item, the container comprising:

an outer case member having a plurality of sidewall panels and a plurality of base panels, the outer case member erectable from a collapsed configuration, in which the container is substantially flat, to an erected configuration, in which the plurality of sidewall panels and the plurality of base panels collectively define an interior cavity to receive the item to be transported; and a pair of partition members, each partition member being separate and distinct from the other and having a foot panel, a side panel and a support panel, the foot panel of each partition member fixedly coupled to a respective one of the plurality of base panels of the outer case member, the side panel of each partition member fixedly coupled to a respective one of the plurality of sidewall panels of the outer case member, and the support panel of each partition member provided between the foot panel and the side panel of each respective partition member to collectively partition the interior cavity of the outer case member into opposing regions and to support a portion of the item to be transported when the outer case member is erected.

2. The container of claim 1 wherein each partition member further includes a supplemental support panel foldably coupled to the support panel, the supplemental support panels of the partition members collectively defining a V-shaped trough on which to support the portion of the item to be transported when the outer case member is in the erected configuration.

3. The container of claim 2 wherein each of the supplemental support panels includes a lock device to secure the partition members in a support configuration when the outer case member is in the erected configuration.

4. The container of claim 1 wherein, the support panel of each partition member is normal to the side panel when the outer case member is in the erected configuration.

5. The container of claim 1 wherein, the support panel of each partition member is parallel to the side panel when the outer case member is in the collapsed configuration.

6. The container of claim 1 wherein, the support panel of each partition member is connected to the foot panel by a respective intermediary web panel such that, when the outer case member moves from the collapsed configuration to the erected configuration, the foot panel rotates the support panel relative to the side panel via the intermediary web panel.

7. The container of claim 6 wherein, when the outer case member is in the erected configuration, each intermediary web panel is inclined relative to the base panels of the outer case member toward a central region of the interior cavity.

8. The container of claim 1 wherein one of the partition members includes a wedge device that cooperates with the support panels of the partition members to define a window when the outer case member is in the erected configuration.

9. The container of claim 8 wherein the wedge device is selectively adjustable to change a size of the window.

10. The container of claim 8 wherein the wedge device is coupled to the side panel of the partition member by an upper panel.

11. An erectable container to transport flowers, the erectable container comprising:

an outer case member including a plurality of sidewall panels and a plurality of base panels; and a pair of partition members, each partition member being separate and distinct from the other and from the outer case member, and each being adhered to a respective one of the plurality of sidewall panels and a respective one of the plurality of base panels of the outer case member, and wherein each partition member is configured to at least partially erect into a stem support structure as the outer case member is erected from a collapsed configuration to an erected configuration, the stem support structure providing a support trough offset from a floor of the outer case member when the stem support structure is completely erected and locked in a support configuration.

12. The erectable container of claim 11 wherein the stem support structure partitions an interior cavity of the outer case member into opposing regions when the outer case member is in the erected configuration and the stem support structure is locked in the support configuration.

13. The erectable container of claim 11 wherein each partition member includes a foot panel, a side panel and a support panel, the foot panel of each partition member fixedly coupled to a respective one of the plurality of base panels of the outer case member, the side panel of each partition member fixedly coupled to a respective one of the plurality of sidewall panels of the outer case member, and the support panel of each partition member provided between the foot panel and the side panel of each respective partition member.

14. The erectable container of claim 13 wherein each partition member further includes a supplemental support panel foldably coupled to the support panel, the supplemental support panels of the partition members collectively defining the support trough on which to support stems of the flowers to be transported when the outer case member is in the erected configuration and the stem support structure is locked in the support configuration.

15. The erectable container of claim 14 wherein each of the supplemental support panels includes a lock device to secure the stem support structure in the support configuration with the outer case member in the erected configuration.

16. The erectable container of claim 13 wherein, the support panel of each partition member is normal to the side panel when the outer case member is in the erected configuration.

17. The erectable container of claim 13 wherein, the support panel of each partition member is parallel to the side panel when the outer case member is in the collapsed configuration.

18. The erectable container of claim 13 wherein, the support panel of each partition member is connected to the foot panel by a respective intermediary web panel such that, when the outer case member moves from the collapsed configuration to the erected configuration, the foot panel rotates the support panel relative to the side panel via the intermediary web panel.

19. An erectable container to transport flowers, the erectable container comprising:

an outer case member; and a pair of partition members, each partition member being separate and distinct from the other and from the outer case member, and wherein each partition member is configured to at least partially erect into a stem support structure as the outer case member is erected from a collapsed configuration to an erected configuration, the stem support structure providing a support trough offset from a floor of the outer case member when the stem support structure is completely erected and locked in a support configuration, and wherein one of the partition members includes a wedge device that cooperates with the stem support structure when the outer case member is in the erected configuration to define a window.

* * * * *